US007638164B2

(12) United States Patent
Aschenbeck

(10) Patent No.: US 7,638,164 B2
(45) Date of Patent: Dec. 29, 2009

(54) METHOD AND APPARATUS FOR EFFICIENT APPLICATION OF PRIME BACKGROUND SHINGLE GRANULES

(75) Inventor: David P. Aschenbeck, Newark, OH (US)

(73) Assignee: Owens Corning Intellectual Capital, LLC DE (US)

( * ) Notice: Subject to any disclaimer, the term of this patent is extended or adjusted under 35 U.S.C. 154(b) by 729 days.

(21) Appl. No.: 11/248,388

(22) Filed: Oct. 12, 2005

(65) Prior Publication Data

US 2007/0082126 A1 Apr. 12, 2007

(51) Int. Cl.
*B05D 1/12* (2006.01)

(52) U.S. Cl. ..... 427/186

(58) Field of Classification Search ..... None
See application file for complete search history.

(56) References Cited

U.S. PATENT DOCUMENTS

| | | | | |
|---|---|---|---|---|
| 2,111,565 | A | 3/1938 | Limerick | |
| 2,233,122 | A | 2/1941 | Burns | |
| 2,821,163 | A | 1/1958 | Walton | |
| 2,905,569 | A | 9/1959 | Zitke | |
| 2,977,924 | A | 4/1961 | Bender et al. | |
| 3,101,281 | A | 8/1963 | Bowen, III | |
| 3,184,324 | A | 5/1965 | Ryckman | |
| 3,886,021 | A | 5/1975 | Breckenfelder | |
| 4,478,869 | A * | 10/1984 | Brady et al. | 427/10 |
| 4,523,543 | A | 6/1985 | Brady et al. | |
| 4,583,486 | A | 4/1986 | Miller | |
| 4,795,661 | A | 1/1989 | Bondoc et al. | |
| 4,900,589 | A | 2/1990 | Montgomery | |
| 5,405,647 | A | 4/1995 | Grubka et al. | |
| 5,520,889 | A | 5/1996 | Burton et al. | |
| 5,547,707 | A | 8/1996 | Haubert et al. | |
| 5,573,810 | A | 11/1996 | Grubka | |
| 5,599,581 | A | 2/1997 | Burton et al. | |
| 5,624,522 | A | 4/1997 | Belt et al. | |
| 5,746,830 | A | 5/1998 | Burton et al. | |
| 5,747,105 | A | 5/1998 | Haubert | |
| 5,766,678 | A | 6/1998 | Belt et al. | |
| 5,776,541 | A | 7/1998 | Belt et al. | |
| 5,795,389 | A | 8/1998 | Koschitzky | |
| 5,795,622 | A | 8/1998 | Belt et al. | |
| 5,858,095 | A | 1/1999 | White et al. | |
| 6,095,082 | A * | 8/2000 | Belt et al. | 118/308 |
| 6,197,368 | B1 | 3/2001 | Valenti et al. | |
| 6,228,422 | B1 | 5/2001 | White et al. | |
| 6,358,319 | B1 | 3/2002 | Huykman et al. | |
| 6,440,216 | B1 | 8/2002 | Aschenbeck | |
| 6,465,058 | B2 | 10/2002 | Huykman et al. | |
| 6,582,760 | B2 | 6/2003 | Aschenbeck | |
| 6,610,147 | B2 | 8/2003 | Aschenbeck | |
| 6,790,307 | B2 | 9/2004 | Elliott | |

* cited by examiner

*Primary Examiner*—Frederick J Parker
(74) *Attorney, Agent, or Firm*—James J. Dottavio; Joan N. Drew

(57) ABSTRACT

A method and apparatus for making shingles includes discharging blend drop granules onto first sections of a moving sheet, and discharging background granules onto second sections of the sheet where the second sections are different from the first sections.

8 Claims, 3 Drawing Sheets

METHOD AND APPARATUS FOR EFFICIENT APPLICATION OF PRIME BACKGROUND SHINGLE GRANULES

TECHNICAL FIELD

This invention relates to methods and apparatus for discharging granules onto a moving substrate. More particularly, this invention relates to a method and apparatus for controlling the flow of background granules from a granule dispenser that supplies granules to be discharged onto the moving substrate.

BACKGROUND OF THE INVENTION

A common method for the manufacture of asphalt shingles is the production of a continuous strip of asphalt shingle material followed by a shingle cutting operation which cuts the material into individual shingles. In the production of asphalt strip material, either an organic felt or a glass fiber mat is passed through a coater containing liquid asphalt to form a tacky asphalt coated strip. Subsequently, the hot asphalt strip is passed beneath one or more granule applicators which apply the protective surface granules to portions of the asphalt strip material.

Often, in the manufacture of shingles, at least two types of granules are employed: 1) headlap granules which are granules of relatively low cost for portions of the shingle which are to be covered up; and 2) prime granules which are granules of relatively higher cost and are applied to the portions of the shingle which will be exposed on the roof. It is to be understood that the term "prime" granules generally includes both highlighted colored blend drop granules and background granules.

Not all of the granules applied to the hot, tacky, asphalt coated strip adhere to the strip, and, typically, the strip material is turned around a slate drum to invert the strip and cause the non-adhered granules to drop off. These non-adhered granules, which are known as backfall granules, are usually collected in a backfall hopper. The backfall hopper dispenses a continuous supply of the "backfall" granules onto the sheet.

To provide a color pattern of pleasing appearance, the shingles are provided in different colors, usually in the form of a series of granule discharges of different colors or different shades. These highlighted series of discharges, referred to as blend drops, are typically made by discharging granules from a series of blend drop granule dispensers. To produce the desired effect, the length and spacing of the blend drops must be accurate. The length and spacing of each blend drop on the sheet is dependent on the relative speed of the sheet and the length of time during which the blend drop granules are discharged.

After discharging the highlighted blend drop granules, an oversupply of background granules is applied to the sheet. In making asphalt shingles, the standard method of prime granule application is to provide a continuous "curtain coater" application of background granules at a backfall hopper. While this method ensures that no surface of the shingle is uncovered, it also results in the already covered blend drop areas receiving 2 to 4 layers of granules (with 1 layer equaling the quantity of granules that sticks to the asphalt coated surface).

This excess amount of background granules is recovered by allowing both the prime and background granules to fall into a backfall hopper during the shingle making process. The backfall hopper has separate compartments that are in general alignment with the areas of the shingle that receive the different types of granules; i.e., the headlap granules and the prime granules. However, in order to ensure that the less expensive background granules are not mixed into the more expensive prime granules, the "prime granule" compartment of the backfall hopper is narrower than the corresponding width of the prime area of the shingle. When the granule covered sheet is passed over a slate drum, only excess prime shingles fall into the narrower prime granule compartment, thus allowing for the recycling of "prime only" granules.

It is desired to provide an improved method and apparatus for discharging background granules onto the moving sheet to produce a uniform distribution of granules without wasting prime background granules.

It is particularly desirable to provide a more efficient and consistent granule discharging system that is more responsive to changes in line speed of the asphalt coated sheet, particularly at the higher line speeds.

Also, it would be helpful to have a granule discharging system with a more accurate control of the discharging of the background granules to provide improved blend drop appearance.

SUMMARY OF THE INVENTION

The above objects, as well as other objects not specifically enumerated, are achieved by apparatus and method for discharging a non-continuous supply of background granules onto a substrate.

In one aspect, the present invention relates to a method of making shingles including discharging blend drop granules onto first sections of a moving sheet; discharging background granules onto second sections of the sheet substantially without applying background granules to the first sections, the second sections being different from the first sections to form a granule coated sheet; and, removing excess blend drop granules and background granules from the granule coated sheet.

In another aspect, the present invention relates to an apparatus for discharging granules onto a substrate including a blend drop granule dispenser for discharging blend drop granules onto first sections of the substrate; and, a background granule dispenser adapted for discharging background granules onto second sections of the substrate substantially without discharging background granules onto the blend drop granules, whereby the first sections of blend drop granules on the substrate are substantially not covered with the background granules.

Various objects and advantages of this invention will become apparent to those skilled in the art from the following detailed description of the preferred embodiment, when read in light of the accompanying drawings.

DETAILED DESCRIPTION OF THE INVENTION

Figure 1:
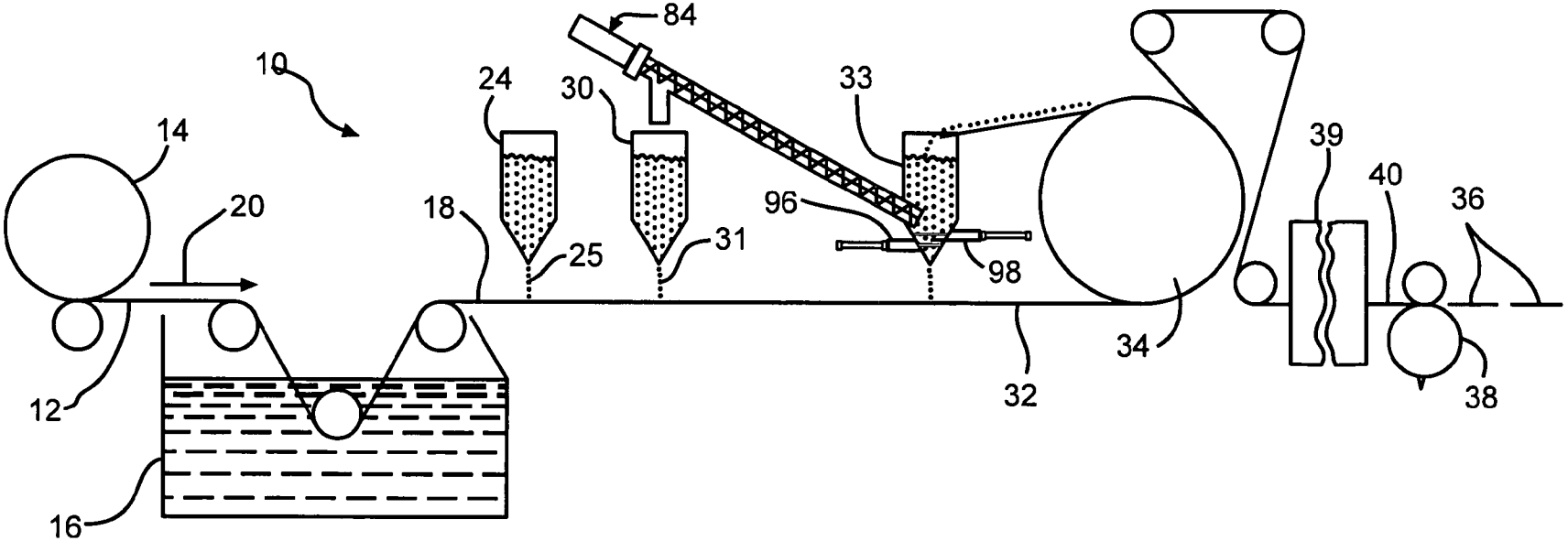
FIG. 1 is a schematic elevational view of a shingle manufacturing operation according to the invention.

As shown in FIG. 1, the apparatus for carrying out the method of the invention is indicated generally at 10. A shingle base mat 12, preferably a fiberglass mat, is dispensed from a roll 14, and passed through an asphalt coater 16 to form an asphalt coated sheet 18. The asphalt coated sheet 18 moves in the machine direction, indicated by arrow 20. The sheet usually moves at a speed of at least about 200 feet/minute (61 meters/minute), and typically at a speed within the range of between about 450 feet/minute (137 meters/minute) and about 800 feet/minute (244 meters/minute). In the embodiment shown, blend drop granule dispenser 24 is positioned above the asphalt coated sheet. The blend drop dispenser 24 is designed to discharge blend drops of granules onto the asphalt coated sheet 18. Different ones of the plurality of blend drop dispensers 24 can be arranged to apply blend drops of different shapes and color blends. It is to be understood, that in the description herein, the blend drops are also referred to as first sections of the asphalt sheet.

Background granules and backfall granules are discharged by a background dispenser 30 onto the asphalt coated sheet 18. It is to be understood, that in the description herein, the background drops are also referred to as second sections of the asphalt sheet.

The background granules are dispensed onto the second sections of the asphalt sheet 18 that are not already covered by the blend drop granules. The background granules are applied to the extent that the asphalt coated sheet 18 becomes completely covered with granules, and the sheet becomes a granule coated sheet 32. Thus, no surface of the shingle is uncovered. The already covered blend drop areas receive only one layer of granules. Also, the second sections of the asphalt sheet only receive one layer of granules.

It is to be understood that, in the explanation herein, the term "layer" generally is meant to mean an amount of granules on the sheet that is approximately equal to the quantity of granules that sticks to the asphalt surface. The "application rate" is the percent of granules applied to the asphalt coated sheet relative to one layer of granules. As such, the present method allows for the efficient initial discharging of granules onto the asphalt sheet at a rate that is within the range from about 110% to about 150% in order to insure total sheet coverage with the granules. In certain embodiments, the rate of application is no greater than about 130%. The rates of application of the blend drop granules 25, the background granules 31 and/or the headlap granules 91 can be the same or different, depending upon the desired manufacturing parameters for the shingle being produced.

The granule coated sheet 32 is then inverted by traveling around a slate drum 34, which causes any excess granules to drop off on the backside of the drum, where the excess granules are collected and segregated.

After passing around the slate drum 34, the granule covered sheet 32 is cooled by a suitable cooling device 39, and the continuous strip 40 is subsequently cut into individual shingles 36 by a chopper 38, and packaged in bundles, not shown, for transportation to customers. The cutting, aligning and/or laminating steps are schematically shown in FIG. 1 and the continuous strips 40 are cut to form the individual shingles 36.

Figure 2:
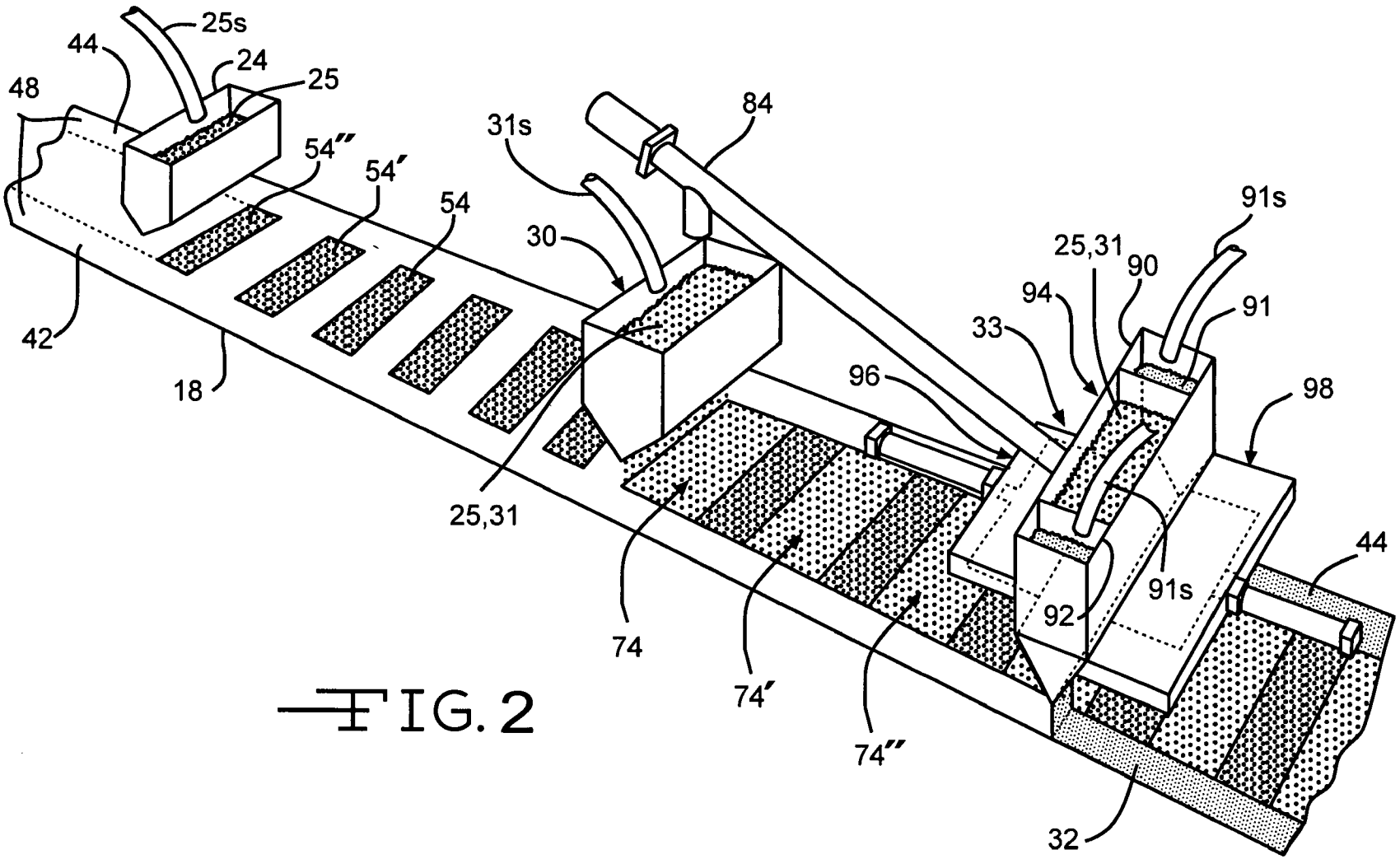
FIG. 2 is a schematic perspective view of the application of the headlap granules, the blend drops, and the background granules to the asphalt coated sheet according to the method of the invention.

In the embodiment shown in FIG. 2, the asphalt coated sheet 18 is processed in a manner such that two shingles are simultaneously made. The asphalt coated sheet 18 can be viewed as being divided into various lanes 42, 44 and 48 during manufacturing, for purposes of illustration, although until the sheet is slit into the various shingle components, it remains a single sheet. The outside lanes 42 and 44 are the headlap lanes for each of the two shingles, respectively. The inner lane 48 receives prime blend drop granules in a series of first sections, generally shown herein as 54, 54', 54", etc.; however, for ease of explanation the first sections will generally be referred to as first section 54. The inner lane 48 also receives background granules in a series of second sections, generally shown herein as 74, 74', 74", etc.; however, for ease of explanation, the second sections will generally be referred to as second section 74. The second sections 74 are the entire surface areas of the inner lane 48 that are not previously covered by blend drops comprising the first sections 54.

The blend drop dispenser 24 holds a quantity of blend drop granules 25 for discharge onto the asphalt coated sheet 18. The blend drop dispenser 24 delivers the blend drop granules 25 onto the asphalt coated sheet 18 to form the blend drop sections 54. Several different types of blend drop dispensers are known in the art, and any of these would be suitable for purposes of the present invention, and granules are fed to the blend drop dispenser 24 from granule supplies (not shown) via supply conduit 25*s*.

The blend drop dispenser 24 extends transversely across the moving asphalt coated sheet 18. It is to be understood that some shingle machines will be set up to make multiple and/or multilayered shingles simultaneously, and blend drops are not needed in the headlap areas of the shingles. Therefore, although the blend drop dispenser 24 can extend partially or all the way across the shingle machine, i.e., across the asphalt coated sheet 18, the blend drop dispenser 24 can be provided with dividers (not shown in FIG. 2) to segment the blend drop dispenser 24 into multiple compartments for accumulating granules of different colors or color blends, which compartments correspond to various blend drops that are to be discharged on the asphalt coated sheet.

Referring again to FIG. 2, the blend drop granules 25 that are to be applied to the asphalt coated sheet 18 are often made up of granules of several different colors. For example, one particular blend drop that simulates a weathered wood appearance includes some brown granules, some dark gray granules and some light gray granules. When these granules are mixed together and applied to the sheet as a blend drop in a generally uniformly mixed manner, the overall appearance of weathered wood is achieved. For this reason, the blend drops are referred to as having a color blend, which gives an overall color appearance, and this overall appearance may be different from any of the actual colors of the granules in the color blend. Also, blend drops of darker and lighter shades of the same color, such as, for example, dark gray and light gray, are referred to as different color blends rather than merely different shades of one color. In other shingle embodiments, the shingles include blend drops that form shadow lines on the tabs and/or cutouts; i.e., the shingle includes granules of a lighter or darker shade at either the top and/or bottom of one or more tabs and/or cutouts. A few examples of shadows are provided in commonly assigned U.S. Pat. No. 6,014,847 to Phillips, which is incorporated herein by reference.

The background granule dispenser 30 sequentially follows the blend drop dispenser 24 and discharges a supply of background granules 31 onto second sections 74 of the inner lane 48 of the asphalt sheet 18. The original background granules 31 are supplied from a source, not shown, via conduit 31*s*. The background granule hopper 30 dispenses a metered supply of the background granules 31 onto the second sections 74 of the asphalt coated sheet 18 at separate and distinct intervals.

In the embodiment shown, the backfall hopper 33 includes a first headlap backfall hopper 90, a second headlap backfall hopper 92, and at least one prime backfall hopper 94 which, in the embodiment shown herein, is disposed between the first and second headlap hoppers 90 and 92, respectively.

The first and second headlap hoppers 90 and 92 discharge headlap granules 91 onto the headlap lanes 42 and 44, respectively. The first and second headlap hoppers are supplied from a source, not shown, via supply conduits 91*s*. For ease of explanation, the headlap lanes 42 and 44 can also be generally referred to herein as third sections of the sheet 18.

Figure 3:
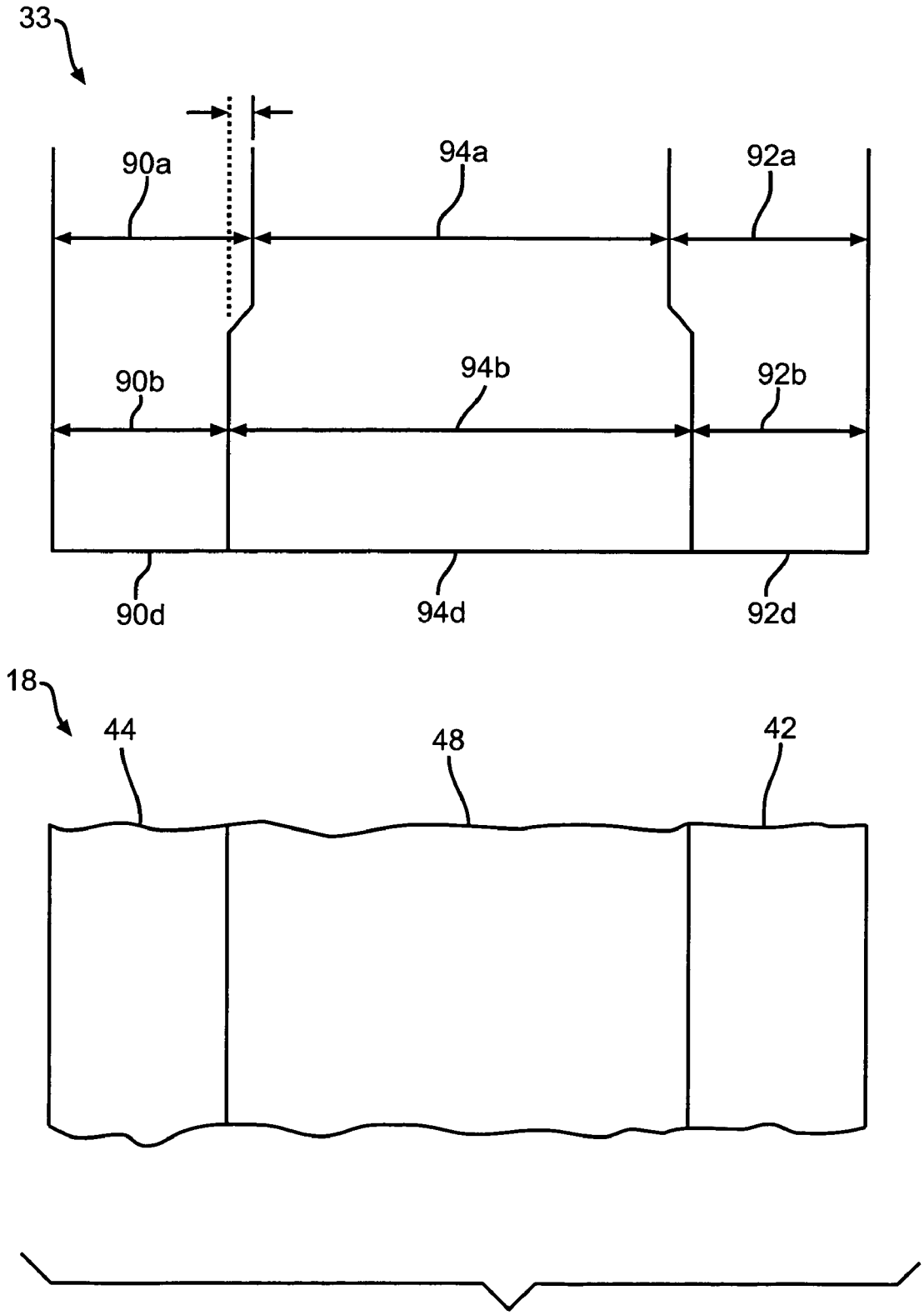
FIG. 3 is a schematic illustration, greatly exaggerated for ease of explanation showing the widths of the hoppers as compared to the widths of the lanes of the shingle.

In order to insure that no headlap granules 91 are dispensed onto the prime areas (i.e., the first blend drop sections 54 and the second background sections 74) of the inner lane 48, the headlap hoppers 90 and 92 each have a transverse catching width 90*a* and 92*a*, respectively, that is longer than the transverse width of the outer, headlap lanes 42 and 44, respectively. In practice, the transverse catching widths 90*a* and 92*a*, respectively of the headlap hoppers 90 and 92, respectively can be from about ⅜ to ¼ inches greater than the transverse widths of each headlap lane 42 and 44, respectively, as schematically illustrated in FIG. 3.

Correspondingly, the transverse catching width 94*a* of the prime backfall hopper 94 is less than the transverse width defined by the prime area (i.e., the inner lane 48). This transverse catching width 94*a* of the prime backfall hopper 94 insures that while some prime granules (both 'blend drop' and 'background' prime granules) will fall into the headlap hoppers 90 and 92, no headlap granules will fall into the prime backfall hopper 94.

In the discharging of granules, the headlap hoppers 90 and 92 each have dispensing portion 90*d* and 92*d*, respectively, at the bottom of each hopper 90 and 92, respectively. The transverse dispensing widths 90*b* and 92*b*, respectively, of the headlap hoppers 90 and 92, respectively, are the same width as the headlap lanes 42 and 44, respectively.

Correspondingly, in the discharging of granules, the prime backfall hopper 94 has dispensing portion 94*d* at the bottom of the hopper 94. The transverse dispensing width 94*b* of the prime backfall hopper 94 is the same transverse width as the prime area (i.e., the inner lane 48).

Thus, the prime backfall hopper 94 collects, mixes and dispenses the excess prime blend drop granules 25 and the excess prime background granules 31, but does not collect or dispense any of the headlap granules 91. It is to be understood that the dispensing portions of the hoppers 90, 92 and 94 can include a granule valve as described and claimed in the co-owned U.S. Pat. No. 6,610,147 B1 or any other suitable granule discharging mechanism.

The mixture of prime blend drop granules 25 and background prime granules 31 is conveyed or recycled from the prime backfall hopper 94 to the background hopper 30. In the embodiment shown in FIG. 2, a prime granule delivery device 84, such as an auger, delivers the mixture of prime blend drop granules 25 and prime background granules 31 from the backfall hopper 94 to the background hopper 30.

During the operation of the apparatus 10 shown in FIG. 2, the supplies of all the types of granules are discharged onto the sheet 18 as follows:

the blend drop dispenser 24 discharges predetermined quantities of blend drop granules 25 onto the series of the first sections 54, 54', 54", etc;

the background granule dispenser 30 discharges predetermined quantities of background granules 31 onto a series of the second sections 74, 74', 74", etc. of the sheet 18 that do not have the blend drop granules thereon; and the headlap hoppers 90 and 92 discharge headlap granules 91 onto the headlap lanes 42 and 44 to form the granule covered sheet 32.

The granule covered sheet 32 is then advanced over the slate drum 34 where excess granules are collected in the backfall hopper 33: (i) the prime blend drop granules 25 and the prime background granules 31 being collected in the prime backfall hopper 94, and (ii) the headlap granules 91 being collected in the headlap hoppers 90 and 92.

Once the excess granules are collected, such excess granules are reapplied for subsequent coating of the sheet 18 in the shingle making operation as follows:

the excess headlap granules 91 which drop off from the headlap lane 42 are collected in the headlap hopper 92 and reapplied onto the headlap lane 42, the excess headlap granules 91 which drop off from the headlap lane 44 are collected in the headlap hopper 90 and reapplied onto the headlap lane 44, and the mixture of the excess prime blend drop granules 25 and the prime background granules 31 are collected in the prime hopper 94, then conveyed via the prime granule delivery device 84 to the background granule dispenser 30, and finally, reapplied onto the second sections 74.

The metered discharging of the prime background granules 25, 31 only onto those second sections 74 of the sheet 18 not already covered with the blend drop granules 25 thus results in a savings in the amount of background granules needed to fully coat the asphalt sheet 18. When the apparatus 10 is in full operation, the background granule dispenser 30 can be throttled back to a very low rate; for example, about 110 to 150 percent application rate.

When the apparatus 10 is beginning operation, or is slowed down, prime granules already present in the prime backfall hopper 94 can be discharged onto second sections 74 of the sheet 18. The prime backfall hopper 94 includes a first gate mechanism 96 which controls the discharging of granules from the prime backfall hopper 94. The opening and closing of the gate mechanism insures that there is no time when the sheet 18 is not being fully covered by granules. When the gate mechanism 96 is closed, the excess granules 25, 31 are collected in the prime backfall hopper 94 and are conveyed via the conveying device 84 to the background hopper 30. This collecting/discharging function of the prime backfall hopper 94 allows for the conservation and subsequent reuse of the expensive prime blend drop granules 25 and the expensive prime background granules 31.

As is also schematically shown in FIG. 2, the backfall hopper 33 also includes a second gate mechanism 98 which controls the discharging of the headlap granules from the headlap hoppers 90 and 92 onto the outer lanes 42 and 44. In this manner, the backfall hopper 33 independently sorts, collects and/or discharges separate supplies of the prime granules 25, 31 and the headlap granules 91.

In one embodiment, the method of the present invention includes (i) collecting the headlap granules into a headlap backfall hopper, and (ii) collecting the blend drop granules and the background granules into a mixture, whereby substantially no headlap granules are collected with the mixture of the blend drop granules and the background granules. The method further includes discharging the mixture 25, 31 of collected blend drop granules and background granules onto second sections 74 of the sheet 18. The mixture 25, 31 of collected blend drop granules and the background granules can be redistributed, or re-discharged, from the background granule dispenser 30 at an application rate from about 110 to about 150 percent. Accordingly, during certain times during the operation, the method further includes conveying the mixture 25, 31 of the collected blend drop/background granules to a point upstream from the collection point of such mixture, and discharging the collected mixture of blend drop/background granules onto second sections 74. As can be seen in FIG. 2, the upstream point can be the background granule hopper 30, whereby an efficient reuse and recycling of the prime (blend drop/background) granules is achieved. The backfall hopper is adapted for collecting and mixing excess blend drop granules and background granules substantially without collecting any headlap granules in the mixture. The backfall hopper also is adapted for collecting the headlap granules and at least a limited supply of excess blend drop/background granules.

By making sure that the background granules are discharged onto the second sections 74 substantially without applying background granules to the first sections 54, a double application of granules onto the first sections 54 is avoided. This means a lesser amount of prime granules fall off the back side of the slate drum 34, and consequently a lesser amount of prime granules are diverted into the headlap hoppers 90, 92 at the edges of the prime granule hopper 94.

This invention has been described as making two shingles simultaneously, i.e., 2-wide, as shown in FIG. 2. It is to be understood that the invention can be applied to shingle manufacturing machines that make any number of shingles simultaneously. For example, it is to be understood that the present invention is also useful to form laminated shingles having overlay and underlay strips which are subsequently laminated together in a process, not shown, that is well known in the art.

The background granule dispenser 30 is adapted or configured to successfully dispense background granules 25, 31 onto second sections of the substrate substantially without discharging background granules onto the blend drop granules. This can be accomplished in several ways. One configuration includes providing a granule dispenser 30 with a high degree of accuracy, enabling the dispensing of granules to be started and stopped with generally sharp edges. Further, an operating program run on a computer can be set up to control the operation of the blend drop dispenser 24 and the background hopper 30 in order to assure that the background granules 25, 31 are deposited substantially only on the second or background sections 74 of the asphalt coated sheet, and not on the first or blend drop sections 54 that are already covered with the blend drop granules. This will result in a granule coated sheet where the first sections of blend drop granules on the substrate are substantially not covered with the background granules. Such an operating program would have to take into consideration the speed of the asphalt coated sheet 18 moving beneath the granule dispensers 24, 30.

INDUSTRIAL APPLICABILITY

This invention will be found to be useful in the production of granule coated discreet roofing shingles suitable for use in residential and commercial roofing applications.

The principles and modes of operation of this invention have been described in its preferred embodiments. However, it should be noted that this invention may be practiced otherwise than as specifically illustrated and described without departing from its scope.

I claim:

1. A method of making shingles comprising:

discharging blend drop granules from one or more blend drop hoppers onto first sections of a moving sheet;

discharging background granules from a backfall hopper onto second sections of the sheet substantially without applying background granules to the first sections, the second sections being different from the first sections, to form a granule coated sheet;

discharging headlap granules from one or more headlap hoppers onto third sections of the sheet;

removing excess blend drop granules and excess background granules from the granule coated sheet, and collecting the removed excess blend drop granules and background granules together in at least one prime backfall hopper to form a mixture of excess prime granules;

removing excess headlap granules from the granule coated sheet and directing the excess headlap granules into at least one headlap backfall hopper; and discharging the mixture of excess prime granules onto second sections of the sheet.

2. The method of claim 1 including discharging the blend drop granules and the background granules at an application rate within a range from about 110 to about 150 percent.

3. The method of claim 1 including discharging the blend drop granules and the background granules at an application rate no greater than about 130 percent.

4. The method of claim 1 including directing the mixture of excess prime granules to the background hopper to be mixed with the background granules before application of the background granules to the sheet.

5. The method of claim 1 further including discharging granules from the background hopper, including the excess mixture of the collected blend drop/background granule, at an application rate within a range from about 110 to 150 percent, as determined by an application rate of the blend drop granules onto the first sections of the sheet.

6. The method of claim 1, further including conveying the excess mixture of the collected blend drop granules and background granules to a hopper upstream from the backfall hopper a.

7. The method of claim 1 further including controlling the discharge of the excess prime granules from the prime backfall hopper independently of the discharge of the headlap granules from the headlap backfall hopper.

8. The method of claim 1 wherein the headlap backfall hopper has a transverse catching width that is longer than a transverse width of the third sections of the sheet, and wherein the prime backfall hopper has a transverse catching width that is shorter than a transverse width of the first and second sections of the sheet.

* * * * *

UNITED STATES PATENT AND TRADEMARK OFFICE

CERTIFICATE OF CORRECTION

PATENT NO. : 7,638,164 B2
APPLICATION NO. : 11/248388
DATED : December 29, 2009
INVENTOR(S) : Aschenbeck It is certified that error appears in the above-identified patent and that said Letters Patent is hereby corrected as shown below:

Column 8, line 41, Please remove bold letter from Claim 6:

The method of claim 1, further including conveying the excess mixture of the collected blend drop granules and background granules to a hopper upstream from the backfall hopper ~~a~~.

Signed and Sealed this

Twenty-third Day of February, 2010

David J. Kappos

David J. Kappos
*Director of the United States Patent and Trademark Office*